United States Patent [19]

Martin

[11] Patent Number: 4,889,102

[45] Date of Patent: Dec. 26, 1989

[54] ARCHERY BOW WITH SLOTTED BOW HANDLE AND ATTACHMENT RECESS

[75] Inventor: Terry G. Martin, Walla Walla, Wash.

[73] Assignee: Martin Archery, Inc., Walla Walla, Wash.

[21] Appl. No.: 216,783

[22] Filed: Jul. 8, 1988

Related U.S. Application Data

[63] Continuation-in-part of Ser. No. 211,844, Jun. 27, 1988, abandoned.

[51] Int. Cl.[4] ..... F41B 5/00

[52] U.S. Cl. ..... 124/88; 124/41 A; 124/13 R

[58] Field of Search ..... 124/88, 41 A, DIG. 1, 124/23 R, 86; D22/107

[56] References Cited

U.S. PATENT DOCUMENTS

| | | | |
|---|---|---|---|
| 2,351,103 | 6/1944 | Brown | 124/23 R |
| 3,844,268 | 10/1974 | Ikeya | 124/88 |
| 3,921,598 | 11/1975 | Helmick | 124/88 |
| 4,124,014 | 11/1978 | Darlington | 124/88 |
| 4,377,152 | 3/1983 | Saunders | 124/DIG. 1 |
| 4,584,189 | 4/1985 | Pietraszek et al. . | |
| 4,704,800 | 11/1987 | Stinson | 124/88 |

OTHER PUBLICATIONS

Martin Archery, Inc., catalog 1987, pp. 18–19.

*Primary Examiner*—Randolph A. Reese
*Assistant Examiner*—Anthony Knight
*Attorney, Agent, or Firm*—Wells, St. John & Roberts

[57] ABSTRACT

An archery bow and an archery bow handle in accordance with the invention includes an arrow window defined by a horizontal shelf and a generally vertical sidewall. An elongated horizontal slot extends through the sidewall and has a minimum predetermined width sufficiently great for slidably receiving a threaded bolt of an archery bow attachment therethrough to enable selective positioning of such an attachment relative to the bow. An elongated shoulder is provided substantially coextensively within the slot and defines bearing surfaces against which a predetermined size threaded nut received by the threaded bolt can tightly bear for securing the attachment to the bow. The width of the widest portion of the slot is sufficiently great to just slidably receive the nut, but prevent such nut from rotating within the slot. The opposite side of the vertical sidewall includes a recess having a threaded hole extending therefrom into the sidewall. The recess is adapted to receive another archery bow attachment which is securable to the bow by a threaded bolt received within the threaded hole.

18 Claims, 5 Drawing Sheets

ARCHERY BOW WITH SLOTTED BOW HANDLE AND ATTACHMENT RECESS

BACKGROUND OF THE INVENTION

This is a continuation-in-part application of my copending patent application Ser. No. 211,844 filed on June 27, 1988, which was expressly abandoned.

TECHNICAL FIELD

This invention relates to archery bows and handles for archery bows.

Archery bows are typically constructed to provide a means for attaching an arrow rest or plunger button immediately above the grip and arrow shelf section of the bow handle. Of the many accessories available for a bow, perhaps the most critical is the arrow rest. Arrow rests range in complexity from simple leather pads on the arrow shelf to full-adjustable systems for horizontal and vertical changes. Due to the nature of the stress on the arrow, particularly using feathered vanes, compound bows should not be "shot off the shelf". This will tend to cause the arrow to fly erratically.

The flipper-type arrow rest is generally accepted as the most versatile rest for all-around use. The flipper type arrow rest is provided within the arrow or site window and provides an elevated platform that will flip out of the way as the arrow is shot. It can be mounted to the handle by an adhesive, or more typically by a mounting bolt received through a threaded hole which extends through the bow handle immediately above the arrow shelf.

Another popular rest is the spring rest. The spring rest mounts through the drilled hole in the riser or sidewall portion of the handle. FIG. 6 illustrates such a configuration. The spring rest is adjustable in both spring tension and horizontal alignment and is accordingly very popular among archers.

Pressure buttons are also commonly mounted through the threaded hole above the arrow shelf. A pressure button is a spring loaded device that is threaded to the hole, and has a spring biased plunger which extends into the arrow window. Upon arrow release, the arrow typically creates pressure against the vertical portion of the bow causing the arrow to waver before the feather or vane can take effect. The pressure button effectively absorbs the shock created by the pressure and allows the arrow to leave the window in a more stable condition. The position of the pressure button relative to the shelf is determined by the location of the threaded hole in the handle. Pages 18 and 19 of the Martin Archery 1987 catalog, incorporated herein by reference, illustrate many of the archery rests and pressure buttons available to the archer today.

Many arrow rests include a base portion which is tightly secured by a bolt received therethrough which threads into the hole on the bow. U.S. Pat. No. 4,548,189 to Pietraszek et al. discloses such a base having an elongated slot which enables both horizontal and vertical adjustment of the launcher portion of the rest relative to the shelf portion of the handle. Correspondingly, this enables adjustment of the arrow rest from the maximum draw point of the bow string. This is advantageous and may be necessary where shorter arrows are used and a full draw of the bow to receive maximum power is desirable. The maximum rearward positioning of the arrow rest is limited by the location of the threaded hole in the bow handle and the length of the arrow rest base. When the base is secured by a bolt positioned at the forward-most portion of the base slot, a minimum distance between maximum draw and the arrow rest will be achieved.

Repeated threading and unthreading of bolts or pressure buttons relative to the threaded handle hole runs the risk of cross threading which could effectively strip the threads. As the threaded hole is typically integrally formed in the handle during manufacture, the handle of a bow with such a threaded hole that has been stripped is potentially useless. The hole must be filled and retapped, or another handle provided for the bow.

This invention is directed to overcoming these and other problems associated with archery bows.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
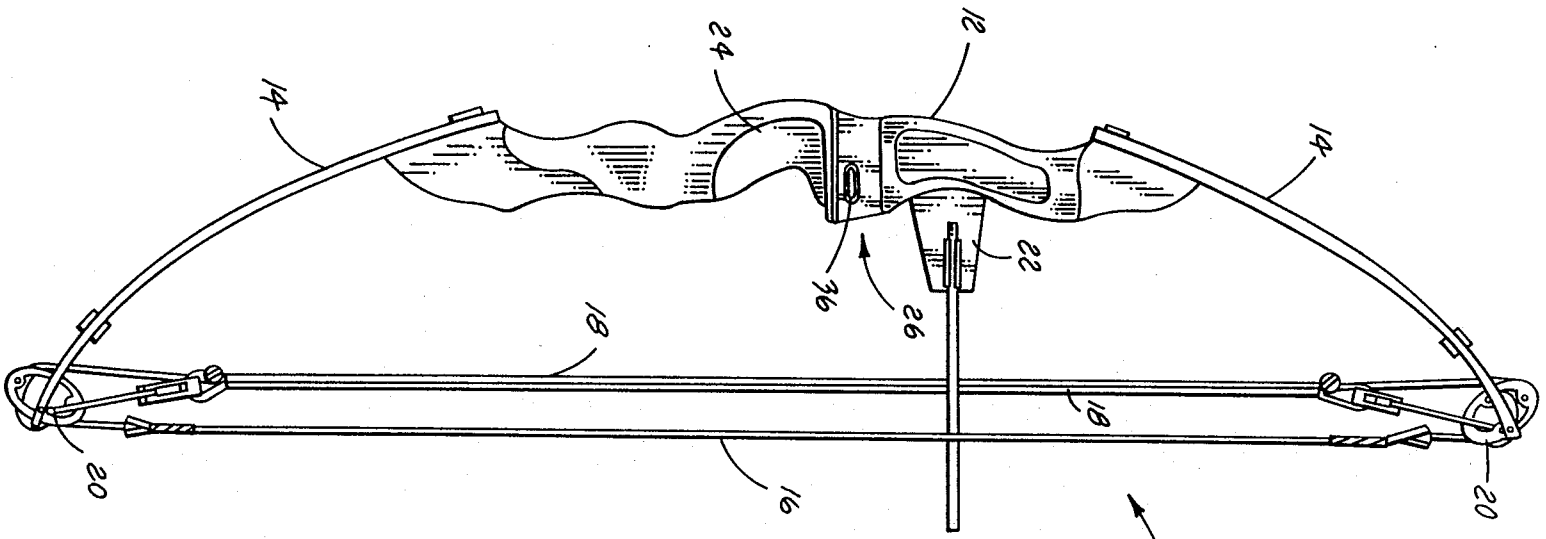
FIG. 1 is a left side elevational view of an archery bow in accordance with the invention.
Figure 2:
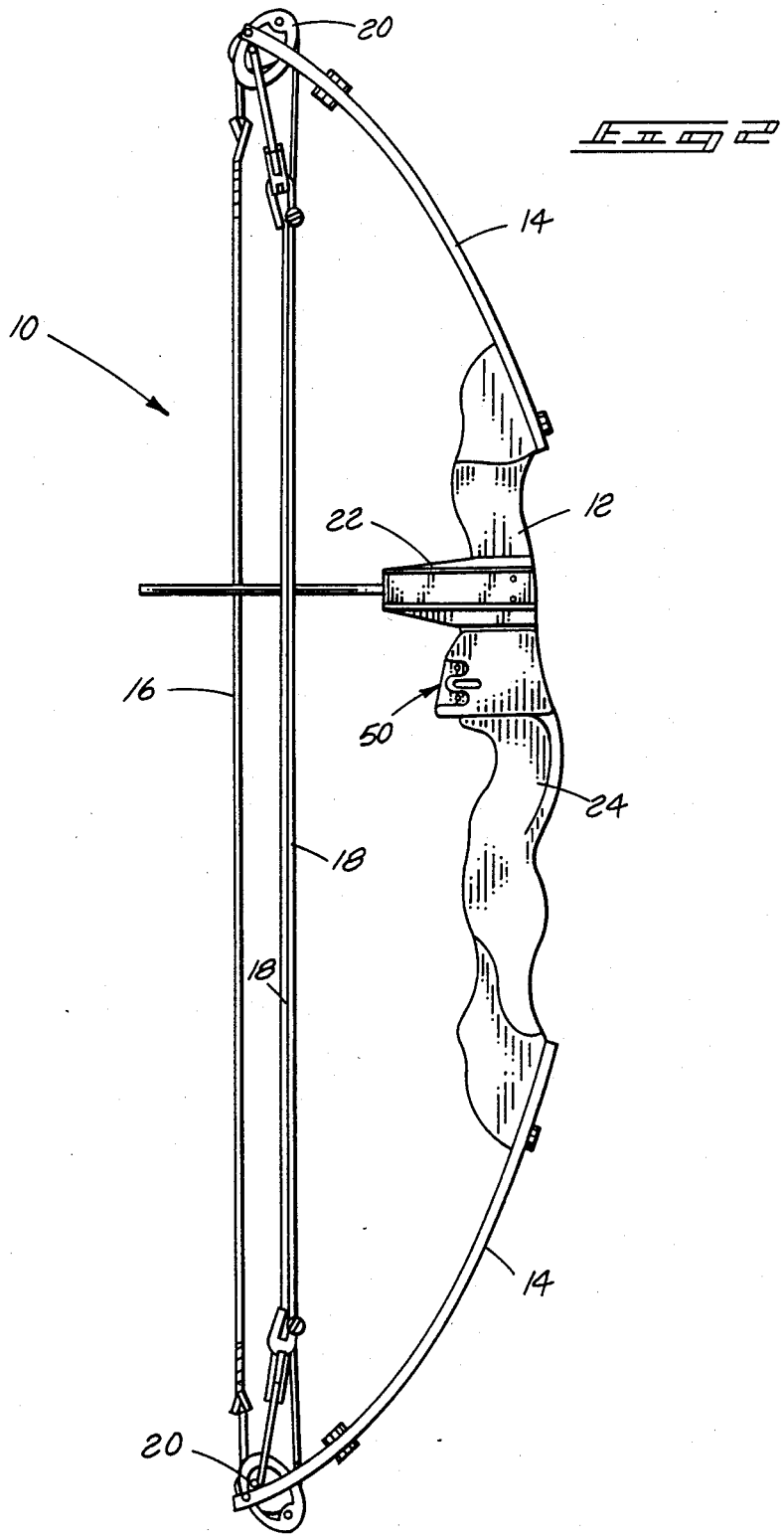
FIG. 2 is a right side elevational view of the archery bow of FIG. 1
Figure 3:
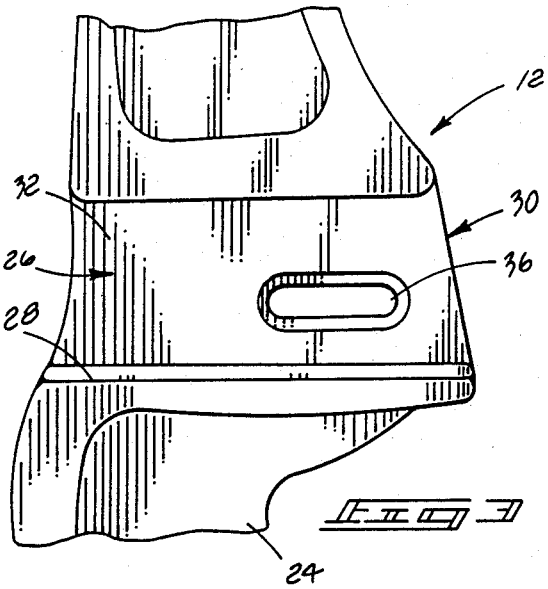
FIG. 3 is an enlarged fragmentary view of a portion of the bow illustrated in FIG. 1 showing in side elevational view an arrow window section.
Figure 4:
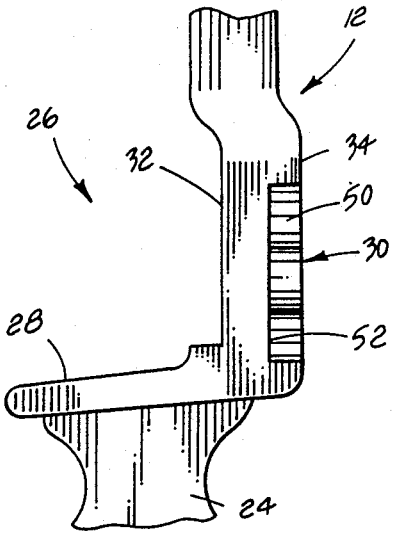
FIG. 4 is an enlarged rear elevational view of the arrow window portion illustrated in FIG. 3.
Figure 6:
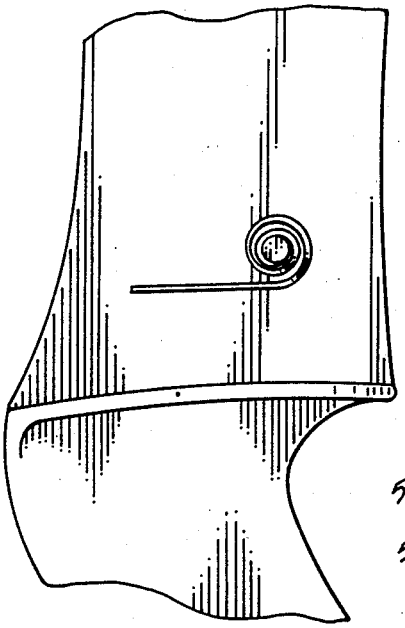
FIG 6 PRIOR ART
FIG. 6 is an enlarged left side elevational view of a prior art handle section of an archery bow showing a conventional spring rest mounted relative thereto.
Figure 5:
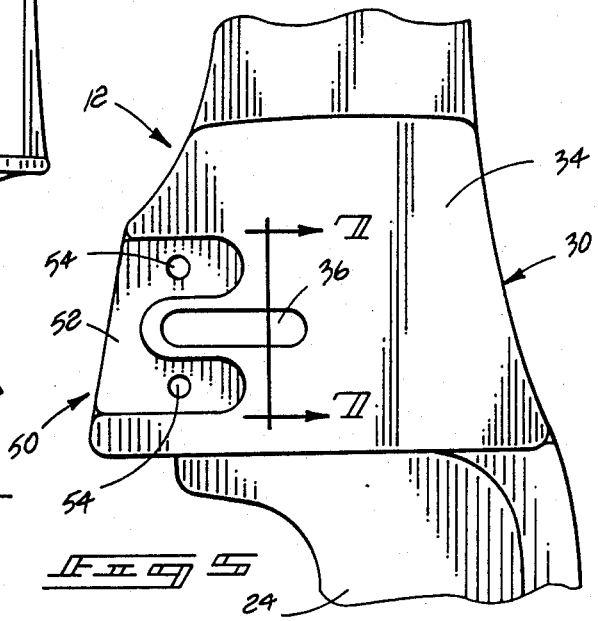
FIG. 5 is an enlarged fragmentary right side elevational view of the FIG. 1 bow.

Referring to FIGS. 1 and 2, an archery bow in accordance with the invention is indicated generally by reference numeral 10. Bow 10 includes a central elongated handle section or body 12 having resilient limbs 14 bolted to opposite ends thereof. A bow string 16 and power cables 18 span between the outer ends of bow limbs 14. Power cables 18 are reeved about eccentric wheel assemblies 20 and are held laterally from bow string 16 by a conventional cable guard assembly 22. The illustrated bow is commonly referred to as a compound bow, although other bows could be employed without departing from the principles and scope of the invention.

Referring more particularly to FIGS. 1–9, archery bow handle 12 includes a hand grip 24 and an arrow window 26 above hand grip 24. Arrow window 26 is defined by a generally horizontal arrow shelf 28 and a generally vertical sidewall or riser portion 30 extending upwardly from one side thereof. Vertical sidewall 30 has opposed first and second generally vertical faces 32, 34 (Fig.4) respectively. First face 32 faces arrow window 26, while second face 34 faces oppositely away from arrow window 26. The handle also has fore and aft edges which define the fore and aft boundaries of the arrow window.

An elongatd slot 36 extends through sidewall 30 from first face 32 to second face 34. Slot 36 is generally oriented transverse relative to the major longitudinal axis of the handle, and extends alongside at least a portion of the aft or back half of the handle. Slot 36 has a minimum predetermined width 'A' (FIG. 7) which is sufficient to slidably receiving a threaded bolt 38 of a first archery bow attachment or an arrow rest assembly therethrough. This enables forward and aft selective positioning of the attachment relative to bow 10. It furthers enables a given attachment to be positioned farther aft of the bow handle than would be possible without such a slot.

Figure 7:
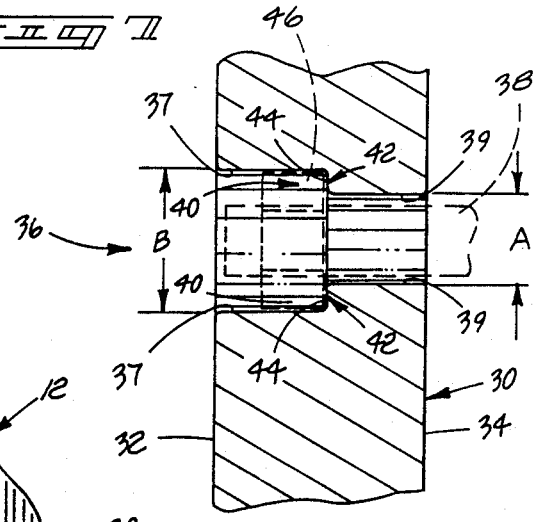
FIG. 7 is a cross-sectional view taken along line 7—7 in FIG. 5 and illustrates a nut and bolt in phantom received relative to the handle.

More particularly, slot 36 is stepped having a first predetermined width 'B' (FIG. 7) where it converges with first sidewall face 32 and a second predetermined width 'A' where it converges with second sidewall face 34. First predetermined width 'B' is greater than second predetermined width 'A'. The stepped or double-width nature of slot 34 defines an elongated shoulder 40 (FIG. 7) which extends coextensively within slot 34. The larger size of the slot opening of first face 32 defines opposed elongated slot walls 37, while the smaller width section of the slot opening of face 34 defines opposed elongated slot sidewalls 39. Shoulder 40 is defined by abutments 42 which extend inwardly from slot sidewalls 37. Abutments 42 have exposed surfaces 44 which face in the same general direction as first sidewall face 32. Exposed surfaces 44 define bear surfaces against which a predetermined size threaded nut 46 received by threaded bolt 38 and slot 36 can tightly bear for tightly securing an arrow rest or pressure button to the bow (FIG. 7).

Width 'B' between slot sidewalls 37 is sufficiently great to slidably receive a nut 46 therebetween, but prevent nut 46 from rotating within slot 36. In this manner, slot sidewalls 37 function to define locking wrench jaws enabling threading of bolt 38 relative to nut 46 but isolating nut 46 from rotation. Turning of bolt 38 in a clockwise manner as viewed from FIG. 2 will pull and tighten nut 46 against shoulder abutment surfaces 44. It should be noted that the nut is recessed in the slot so that neither the nut 46 nor the end of the bolt 38 extends outward from surface or wall 32.

Figure 8:
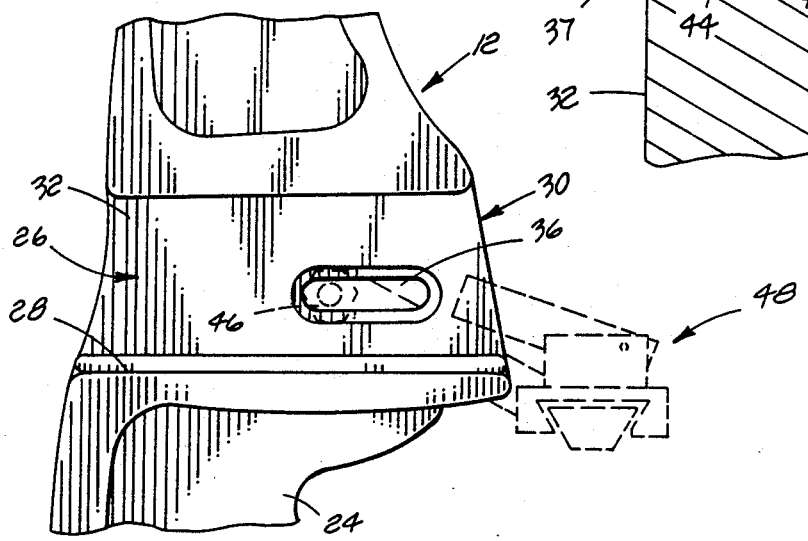
FIG. 8 is an enlarged left side elevational view of the arrow window portion with an arrow rest being illustrated in phantom secured thereto in a first position.
Figure 9:
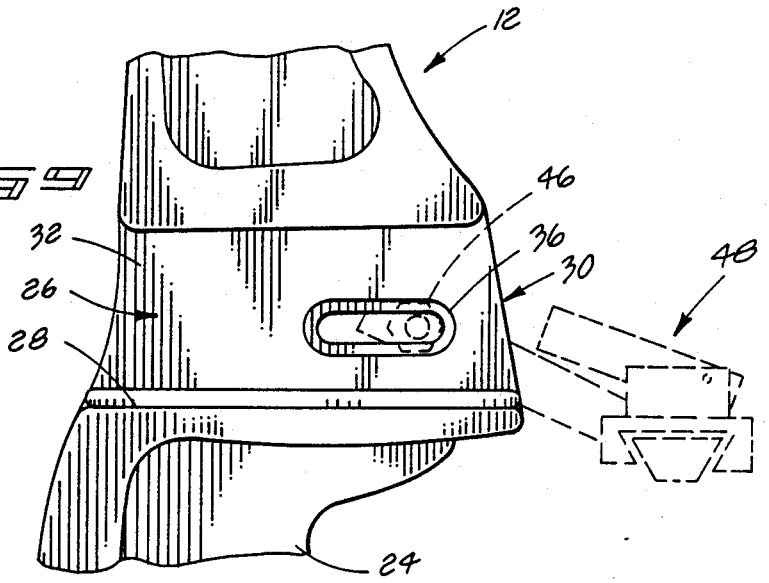
FIG. 9 is an enlarged left side elevational view of the arrow window portion with an arrow rest being illustrated in phantom secured thereto in a second position.

FIGS. 8 and 9 illustrate the capability of alternate positioning of an arrow rest assembly 48 horizontally relative to bow handle 12. This enables movement of an arrow rest further back on the bow than previously possible. Such a construction also provides the advantage of enabling movement of a plunger button relative to the shelf portion of a bow handle, unlike the prior art single threaded hole. The nut functions to provide a horizontally movable threaded hole for receiving the locking bolt.

Bow handle 12 further comprises a recess portion 50 (FIGS. 2 and 5) extending inwardly into sidewall 30 from second sidewall face 34. Recess 50 curves or extends from adjacent one side of slot 36 on face 34 around the rear end of slot 36 to adjacent the other side of slot 36. Recess 50 defines a recess base surface having a pair of threaded holes 54 on opposite sides of slot 36 extending into sidewall 30.

Figure 10:
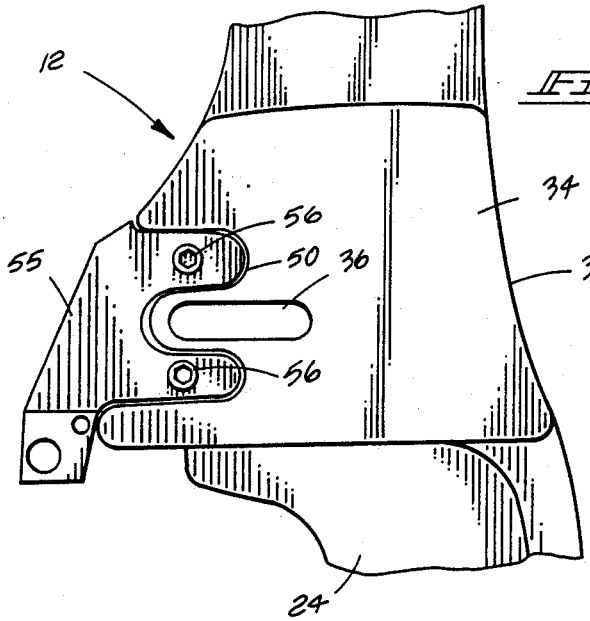
FIG. 10 is an enlarged right side elevational view like FIG. 5, but illustrating an overdraw arrow shelf extender being secured relative thereto.
Figure 11:
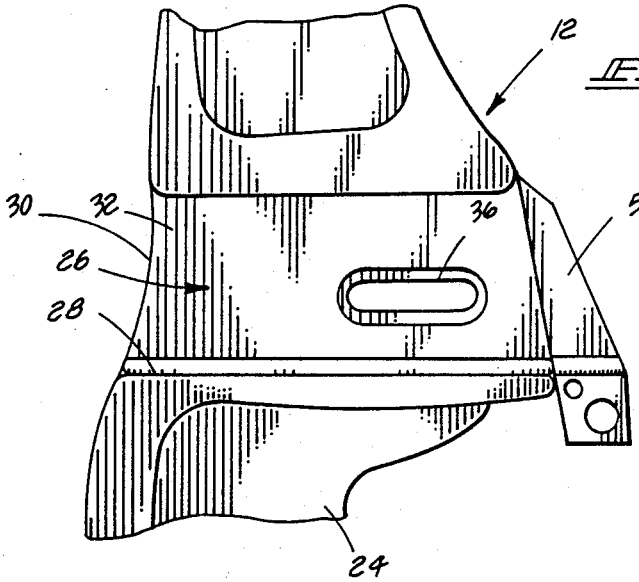
FIG. 11 is a left side elevational view of FIG. 10.

As illustrated in FIGS. 10 and 11, recess 50 is adapted to receive a second archery bow attachment 55 which is securable to the bow by threaded bolts 56 received within threaded holes 54. Second archery bow attachment 55 as illustrated is in the form of an overdraw rearward arrow shelf extension for handle 12. Alternate archery bow attachments could also be developed and employed for such a recess as will be appreciated by the artisan.

Both slot 36 and recess 50 might be simultaneously employed for separate attachments depending on the shape and configuration of the particular archery bow attachments. Also, archery bow attachments other than pressure buttons and arrow rest assemblies could be secured relative to slot 36.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An archery bow handle comprising:

an elongated handle body of predetermined length defining a major longitudinal handle axis, the handle body having a fore edge and an aft edge which define a varying handle body width along the body length;

a hand grip extending along the major longitudinal axis;

an arrow window above the hand grip, the arrow window being defined by a generally horizontal bow shelf and a generally vertical sidewall, the arrow window having a length extending generally transverse to the major longitudinal handle axis between the fore and aft edges of the handle body, the major longitudinal handle axis bisecting the arrow window into a fore half and an aft half, the generally vertical sidewall having opposed first and second generally vertical faces, the first face facing the arrow window, the second face facing oppositely away from the arrow window; and an elongated slot of predetermined length extending through the generally vertical sidewall from the first face to the second face, the slot extending generally transverse to the major longitudinal axis and alongside at least a portion of the aft window half, the slot having a minimum predetermined width sufficient to slidably receive a threaded bolt of a first arrow rest or pressure button attachment therethrough to enable selective positioning of the attachment generally transverse relative to the major longitudinal handle axis, and to a position farther aft of the bow handle than would be possible without such elongated slot.

2. The bow handle of claim 1 further comprising a recess portion extending inwardly into the handle sidewall from the second sidewall face, the recess portion having a recess base surface, at least one threaded hole extending into the sidewall from and through the recess base surface, the recess being adapted to receive a second archery bow attachment which is securable to the bow by a threaded bolt received within the threaded hole.

3. An archery bow incorporating the handle of claim 2.

4. The bow handle of claim 2 wherein the recess portion extends from adjacent one side of the slot, around an end of the slot to adjacent the other side of the slot.

5. An archery bow incorporating the handle of claim 4.

6. An archery bow incorporating the handle of claim 1.

7. The bow handle of claim 1 further comprising:

an elongated shoulder provided substantially coextensively within the slot, the shoulder being defined by opposed inwardly facing abutments, the abutments being separated by a space therebetween having a width sufficient to slidably receive the threaded bolt of the first arrow rest or pressure button attachment therethrough, the abutments having exposed surfaces facing generally in the direction of the arrow window, the exposed surfaces defining bearing surfaces against which a predetermined size threaded nut received by the threaded bolt and slot can tightly bear for securing a first archery bow attachment to the bow, the slot defining locking wrench jaws that are adapted to slidably receive the predetermined size threaded nut therebetween but prevent such nut from rotating within the slot.

8. The bow handle of claim 7 further comprising a recess portion extending inwardly into the handle sidewall from the second sidewall face, the recess portion having a recess base surface, at least one threaded hole extending into the sidewall from and through the recess base surface, the recess being adapted to receive a second archery bow attachment which is securable to the bow by a threaded bolt received within the threaded hole.

9. The bow handle of claim 8 wherein the recess portion extends from adjacent one side of the slot, around an end of the slot to adjacent the other side of the slot.

10. An archery bow incorporating the handle of claim 9.

11. An archery bow incorporating the handle of claim 7.

12. An archery bow incorporating the handle of claim 8.

13. An archery bow handle defining a major longitudinal handle axis, the handle comprising:

a hand grip and an arrow window above the hand grip, the arrow window being defined by a generally horizontal bow shelf and a generally vertical sidewall, the generally vertical sidewall having opposed first and second generally vertical faces, the first face facing the arrow window, the second face facing oppositely away from the arrow window;

an elongated slot extending through the generally vertical sidewall from the first face to the second face, the slot extending generally transverse to the major longitudinal axis, the slot having a minimum predetermined width sufficient to slidably receive a threaded bolt of a first arrow rest or pressure button attachment therethrough to enable selective positioning of the attachment generally transverse relative to the major longitudinal handle axis; and an elongated shoulder provided substantially coextensively within the slot, the shoulder being defined by opposed inwardly facing abutments, the abutments being separated by a space therebetween having a width sufficient to slidably receive the threaded bolt of the first arrow rest or pressure button attachment therethrough, the abutments having exposed surfaces facing generally in the direction of the arrow window, the exposed surfaces defining bearing surfaces against which a predetermined size threaded nut received by the threaded bolt and slot can tightly bear for securing a first archery bow attachment to the bow, the slot defining locking wrench jaws that are adapted to slidably receive the predetermined size threaded nut therebetwen but prevent such nut from rotating within the slot.

14. The bow handle of claim 13 further comprising a recess portion extending inwardly into the handle sidewall from the second sidewall face, the recess portion having a recess base surface, at least one threaded hole extending into the sidewall from and through the recess base surface, the recess being adapted to receive a second archery bow attachment which is securable to the bow by a threaded bolt received within the threaded hole.

15. An archery bow incorporating the handle of claim 14.

16. The bow handle of claim 14 wherein the recess portion extends from adjacent one side of the slot, around an end of the slot to adjacent the other side of the slot.

17. An archery bow incorporating the handle of claim 16.

18. An archery bow incorporating the handle of claim 13.

* * * * *